US008300868B2

(12) United States Patent
Kilburn et al.

(10) Patent No.: US 8,300,868 B2
(45) Date of Patent: Oct. 30, 2012

(54) FABRIC BAG INCLUDING CONTROL DEVICE

(75) Inventors: Gemma Kilburn, West Drayton (GB); Tania Jane Beagley, London (GB)

(73) Assignee: Peratech Limited, Brompton on Swale (GB)

( * ) Notice: Subject to any disclaimer, the term of this patent is extended or adjusted under 35 U.S.C. 154(b) by 800 days.

(21) Appl. No.: 11/992,870

(22) PCT Filed: Sep. 29, 2006

(86) PCT No.: PCT/GB2006/003618

§ 371 (c)(1),
(2), (4) Date: Jun. 22, 2009

(87) PCT Pub. No.: WO2007/036728

PCT Pub. Date: Apr. 5, 2007

(65) Prior Publication Data

US 2009/0279811 A1 Nov. 12, 2009

(30) Foreign Application Priority Data

Sep. 30, 2005 (GB) ..... 0519930.2
Sep. 30, 2005 (GB) ..... 0519931.0

(51) Int. Cl.
*H04R 1/02* (2006.01)
*H04R 9/06* (2006.01)

(52) U.S. Cl. ..... 381/334; 381/301; 381/388; 381/124; 383/127

(58) Field of Classification Search ..... 381/300, 381/301, 333, 334, 388, 124; 700/94; 704/272; 383/127

See application file for complete search history.

(56) References Cited

U.S. PATENT DOCUMENTS

| | | | | |
|---|---|---|---|---|
| 4,050,493 | A * | 9/1977 | Cho | 150/106 |
| 5,409,152 | A * | 4/1995 | Trevino | 224/576 |
| 5,897,042 | A * | 4/1999 | Sims | 224/576 |
| 7,348,506 | B2 * | 3/2008 | Sandbach et al. | 200/52 R |
| 2003/0103038 | A1 | 6/2003 | Wong et al. | |
| 2005/0023186 | A1 | 2/2005 | Hassett | |
| 2005/0230445 | A1 * | 10/2005 | Woo | 224/576 |
| 2008/0024438 | A1 * | 1/2008 | Collins et al. | 345/156 |

FOREIGN PATENT DOCUMENTS

| | | | |
|---|---|---|---|
| GB | 2 411 539 | A | 8/2005 |
| WO | WO-00/72239 | A | 11/2000 |
| WO | WO-2005/073685 | A | 8/2005 |

OTHER PUBLICATIONS

Anonymous: "Wearable Control" IEE Review, vol. 51, No. 7, Jul. 2005, p. 54, XP002416910, ISSN: 0953-5683, Section 8.

Michael Kanellos: "Start-up promotes electric clothes, backpacks" Internet Article, [Online] Jun. 1, 2005, XP002416911 Retrieved from the Internet: URL:http://web.archive.org/web/20050601000609/news.com.com/2102-1041_3-5720566.html> [retrieved on Jan. 25, 2007] the whole document.

* cited by examiner

*Primary Examiner* — Xu Mei

(74) *Attorney, Agent, or Firm* — Harness, Dickey & Pierce, P.L.C.

(57) ABSTRACT

A fabric bag for holding an audio playback device. The fabric bag includes a control device constructed substantially in fabric for controlling an audio playback device. The control device comprises a control portion having indicated regions thereon. The indicated regions are responsive to individually applied manual presses so as to control discrete operations of said audio playback device, and the control portion, including the indicated regions, is responsive to manually applied strokes or gestures so as to control variable operations of the audio playback device.

13 Claims, 10 Drawing Sheets

FABRIC BAG INCLUDING CONTROL DEVICE

CROSS REFERENCE TO RELATED APPLICATIONS

This application claims priority from United Kingdom Patent Application No. 05 19 930.2, filed 30 Sep. 2005, and United Kingdom Patent Application No. 05 19 931.0, filed 30 Sep. 2005, the entire disclosures of which are incorporated herein by reference in their entirety.

TECHNICAL FIELD

The present invention relates to a fabric bag for holding an audio playback device that includes a control device constructed substantially in fabric for controlling an audio playback device.

BACKGROUND OF THE INVENTION

International patent publication no. WO 2005/073685 A1 discloses a linear pressure sensor. In one application, the sensor is incorporated into a lanyard that has characters or symbols printed on the surface, representing controls for an audio playback device. A user can interact with the sensor by stroking and/or pressing the characters or symbols, and by such action control functions of the audio playback device such as play functions and volume control.

A fabric sensor in the form of a keyboard for a portable electronic processing device is disclosed in international patent publication no. WO 01/75572 A2. Graphics corresponding to keys are displayed and a user can interact with the keyboard by pressing in the region of a key, and by such action send alphanumeric characters to the portable electronic processing device. It is described that in one application a dynamic movement, such as the sweeping of a finger across the keyboard, could be used to shift from lower case to upper case letters.

BRIEF SUMMARY OF THE INVENTION

According to an aspect of the present invention, there is provided a fabric bag for holding an audio playback device, wherein said fabric bag includes a control device constructed substantially in fabric for controlling an audio playback device, the control device comprising: a control portion having indicated regions thereon; wherein said indicated regions are responsive to individually applied manual presses so as to control discrete operations of said audio playback device, and said control portion, including said indicated regions, is responsive to manually applied strokes or gestures so as to control variable operations of said audio playback device.

Thus, substantially the same portion of fabric can be used to control discrete operations of the audio device, such as activating the audio device to play, stop, move forward, move in reverse, select or mute, and also variable operations, such as volume level control, tone control or menu scrolling etc.

According to a second aspect of the present invention, there is provided a fabric bag including an interface means to facilitate the transmission of a modulated electrical (audio) signal to an audio transducer (earpiece).

According to a third aspect of the present invention, there is provided a fabric bag also including an amplifier and an integral loudspeaker.

Thus, audio signals transmitted from the audio device may be heard through an earpiece or an integral loudspeaker.

DESCRIPTION OF THE BEST MODE FOR CARRYING OUT THE INVENTION

FIG. 1

Figure 1:
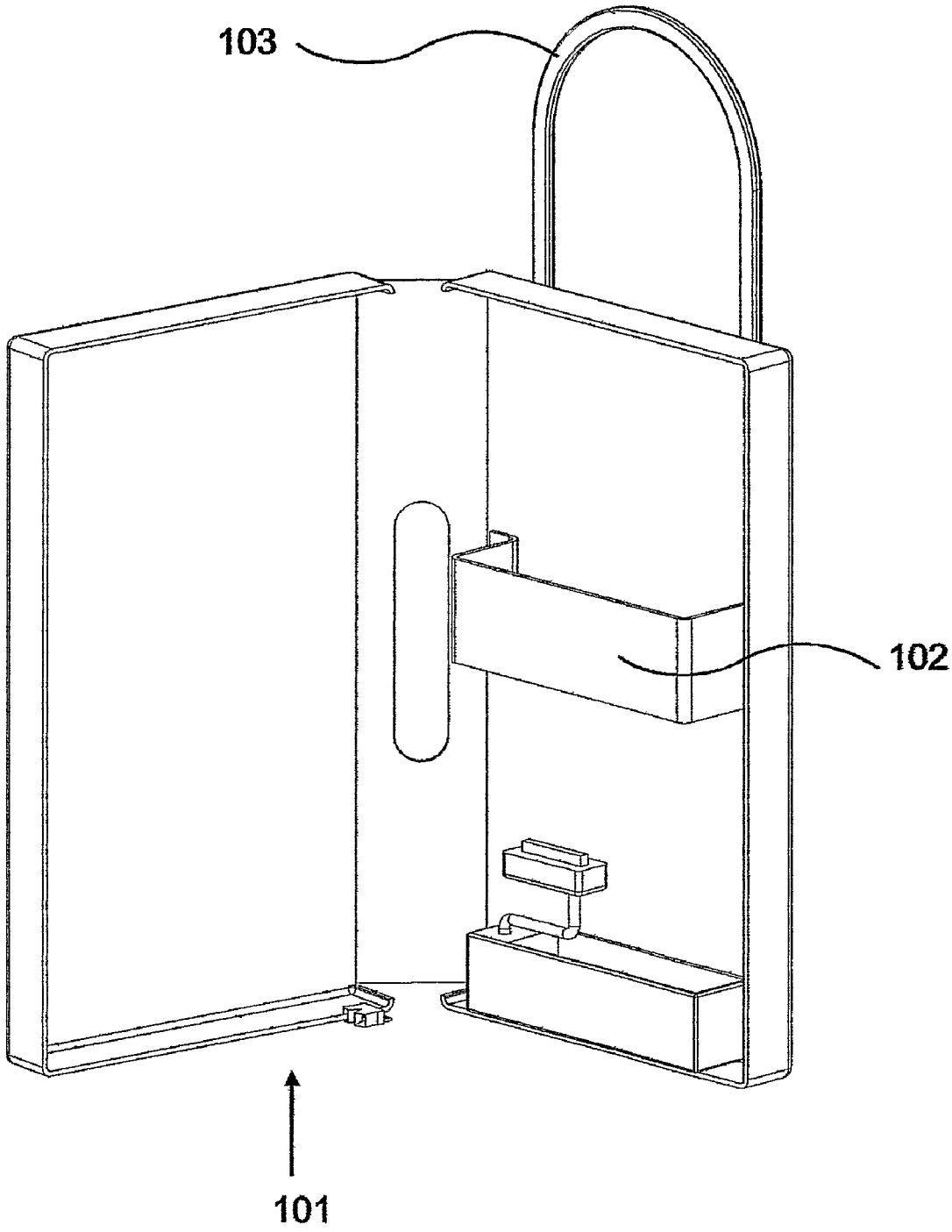
FIG. 1 shows a fabric bag for holding an audio playback device.

A fabric bag 101 is shown in FIG. 1 suitable for holding an audio playback device, such as a portable device usually configured to provide an audio signal to stereo headphones. Such devices may work using magnetic tape, magnetic discs, data discs or solid state storage devices. Increasingly, these devices produce an audio output signal from digital data files, including compressed audio data files such as those identified by the designation MP3.

The bag is constructed primarily of a hard-wearing fabric, such as a woven nylon material, and may include many different external designs to suit particular tastes. A control device (not shown in FIG. 1) for controlling aspects of the audio apparatus operations is also included within the fabric of the bag. Thus, the bag includes a fabric control portion responsive to manual pressure applied thereto and configured to control an operation of the audio playback device.

The bag includes supporting means, such as an elastic supporting strap 102, for supporting the audio playback device firmly within the bag. Preferably, the fabric bag also includes carrying means, such as carrying strap 103, to facilitate carrying the bag.

FIG. 2

Figure 2:
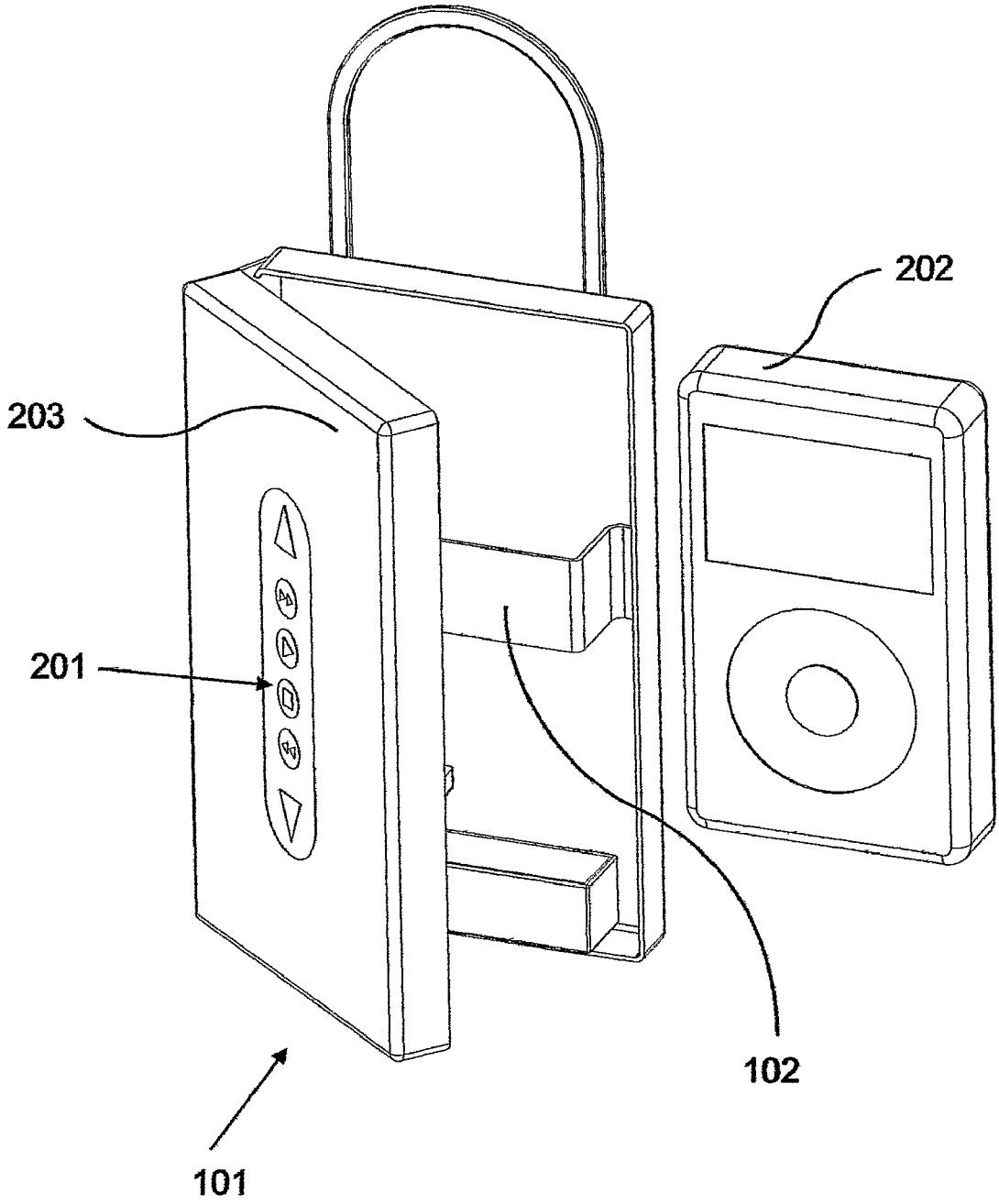
FIG. 2 shows an audio playback device being inserted into the fabric bag of FIG. 1.

Control portion 201 of fabric bag 101 is shown in FIG. 2, in which an audio playback device 202 is shown ready to be inserted within the fabric bag 101, to be supported within the elastic supporting strap 102.

In this first embodiment, The fabric control portion 201 is presented on an external surface 203 of the bag. A control portion as described may include an external surface or a cover layer that carries representations of different regions.

FIG. 3

Figure 3:
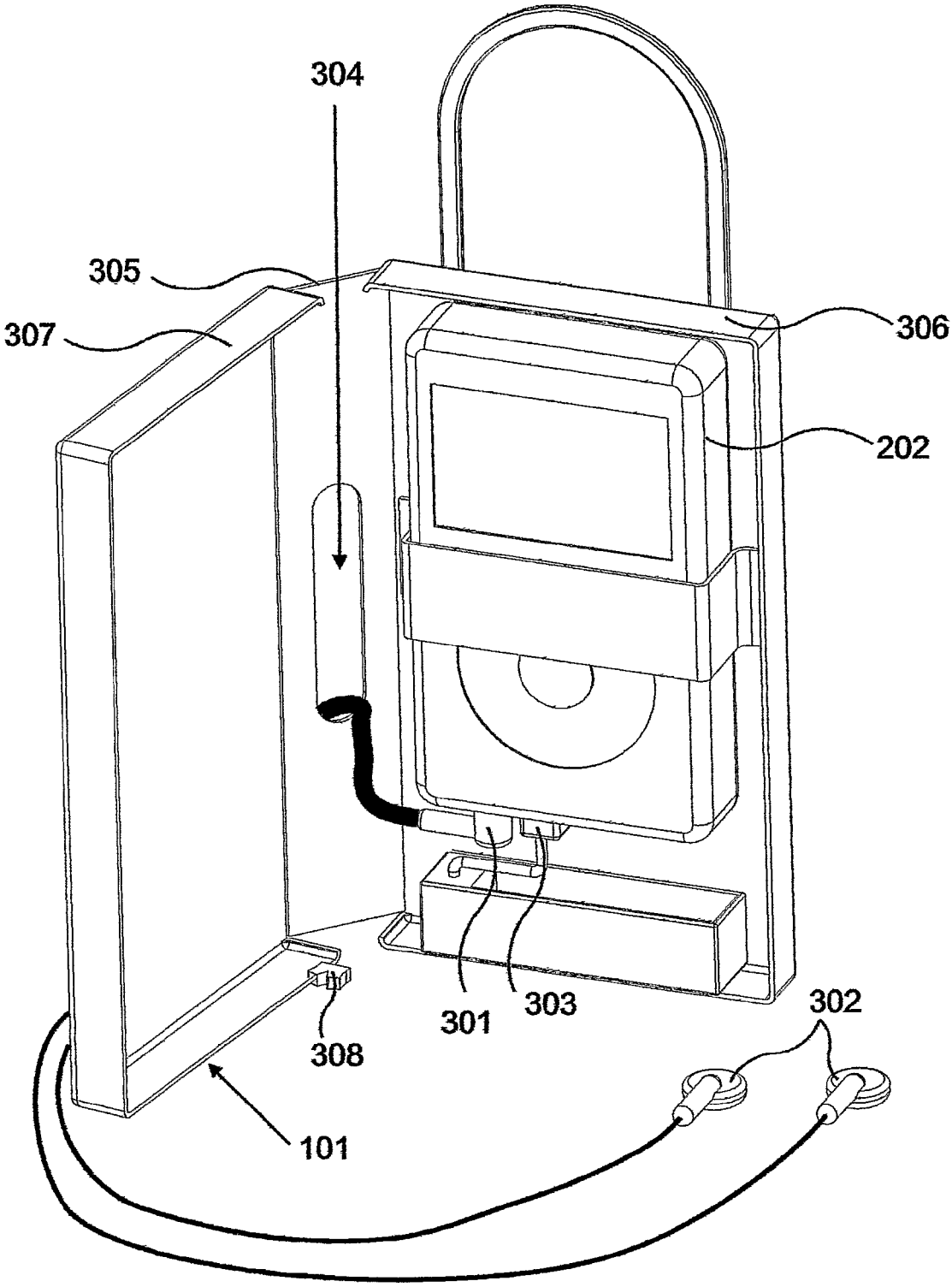
FIG. 3 shows an audio playback device secured within the fabric bag of FIGS. 1 and 2.

The fabric bag 101 illustrated in FIGS. 1 and 2 is shown in an open configuration in FIG. 3 with the audio playback device 202 secured in the bag, ready for operation.

An audio cable 301 is provided for supplying audio signals to suitable stereo headphones 302. Audio cable 301 is configured to be plugged into an interface socket of the audio playback device 202, as shown.

In addition, a control lead 303, associated with the control portion, is provided that may be used to control operations of the audio playback device 202. Control lead 303 is received within an interface socket within the bag such that a fabric control portion 201 of the bag may be used to control operations of the audio playback device 202. Control lead 303 is shown plugged directly into an interface socket of the audio playback device 202.

To facilitate the connection of earphones 302 into an interface socket within the fabric bag 101, the bag defines an aperture 304 through which a cable can be inserted into the bag.

Figure 4:
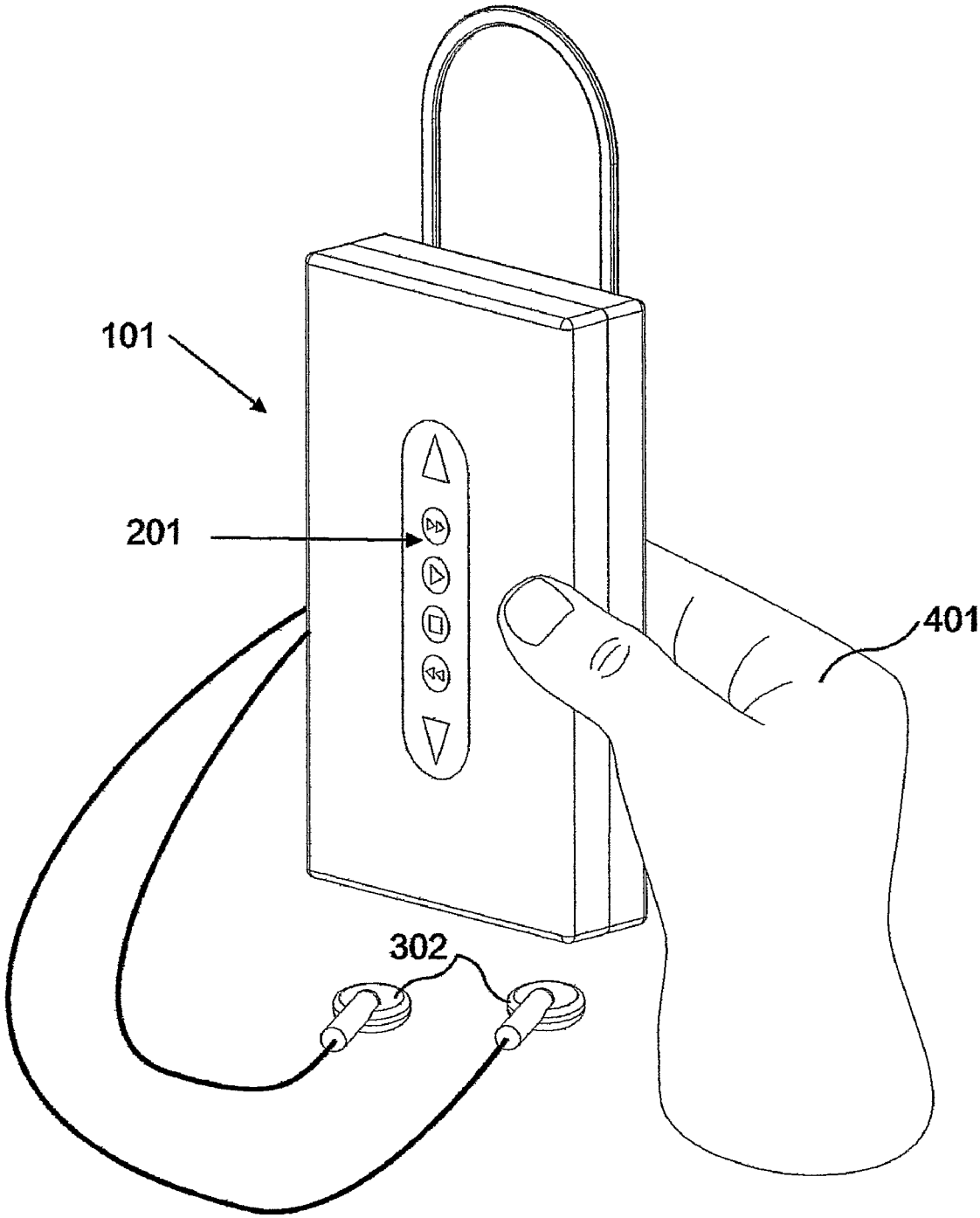
FIG. 4 shows the fabric bag of FIGS. 1, 2 and 3 being manually transported.

In this example, the fabric bag 101 has a central side wall 305 and a pair of outer side walls, including rear wall 306 and front wall 307, extending from opposite edges of the central side wall 305. A zip closure 308 is distributed along the three free edges of the outer side walls 305, 306, 307 to allow the fabric bag 101 to be repeatedly closed and opened. As illustrated, aperture 304 is defined within the central side wall 305. This arrangement prevents a lead extending through the aperture 304 from interfering with the zip closure 308, such that the fabric bag 101 can be closed up whilst an ear piece is connected, as shown in FIG. 4. It is to be appreciated that the type and arrangement of bag closure may vary between applications.

FIG. 4

As shown in FIG. 4, the fabric bag 101 of FIGS. 1, 2 and 3 is dimensioned to be conveniently transportable within a single hand 401. In this way, the bag does not detract from the portability of the audio playback device received inside, and also provides a degree of protective covering for the device. The use of opaque materials in the fabrication of the bag provides the bag with a facility to obscure the device inside from view, which in some circumstances is a desirable personal safety feature.

As previously described, the fabric bag 101 allows earphones 302 to be used whilst the bag is closed. Aspects of the audio playback device operations may be controlled by the application of manual pressure to control portion 201.

FIG. 5

Figure 5:
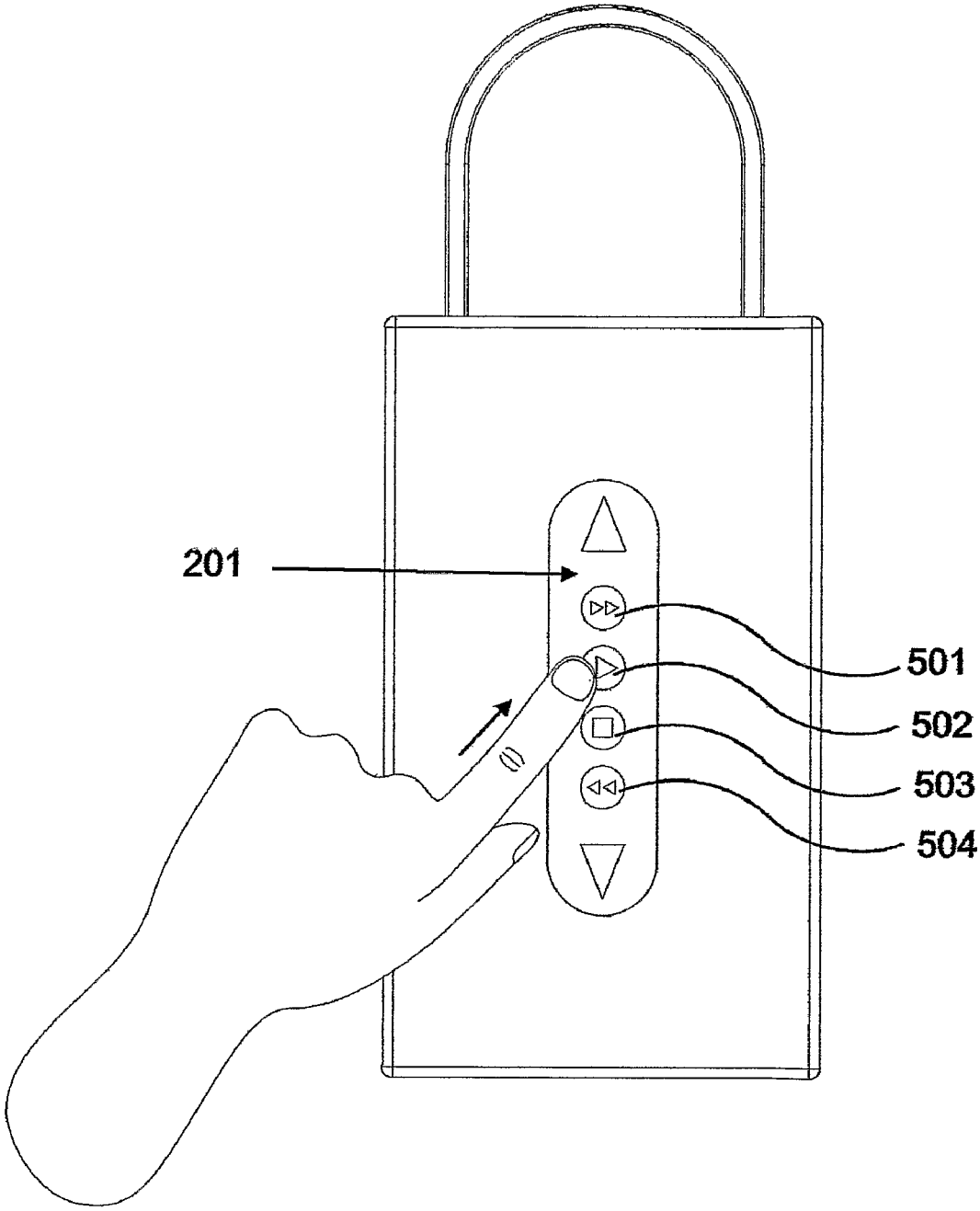
FIGS. 5 and 6 show a control portion constructed substantially in fabric of the fabric bag of FIGS. 1-4.

Control portion 201 can be seen in greater detail in FIG. 5. In this example, indicated regions include a first region 501, a second region 502, a third region 503 and a fourth region 504. In FIG. 5, a manual press is shown against region 502. This results in the audio playback device receiving an instruction to play a track. Similarly, pressure applied to region 503 results in the audio playback device ceasing to play a track; that is to say it results in the application of a stop operation.

In a similar fashion, a manual press applied to region 501 results in a fast forward operation and a manual press applied to region 504 results in a rewind operation. However, the control portion 201, even at the positions of the specific regions, remains sensitive to manually applied strokes or gestures, including swipe actions, tapping actions and scrolling actions. Thus, in this way, substantially the same portion of fabric can be used to control discrete operations (switching the device on and off, select, mute etc) and to control variable operations (such as volume level control, tone control, menu scrolling etc).

The fabric control portion incorporated in the fabric bag of this example is substantially linear, in that the control portion 201 is elongate and the location of presses or strokes or gestures on the control portion are distinguishable by position along a line. Thus, the indicated control regions can be viewed as being superimposed on the substantially linear portion of the control device. The perimeter of the control portion may be visible to facilitate the application of manually applied strokes or gestures within the control portion.

It is to be appreciated that the shape of the control portion and the arrangement of regions may vary between applications.

FIG. 6

Figure 6:
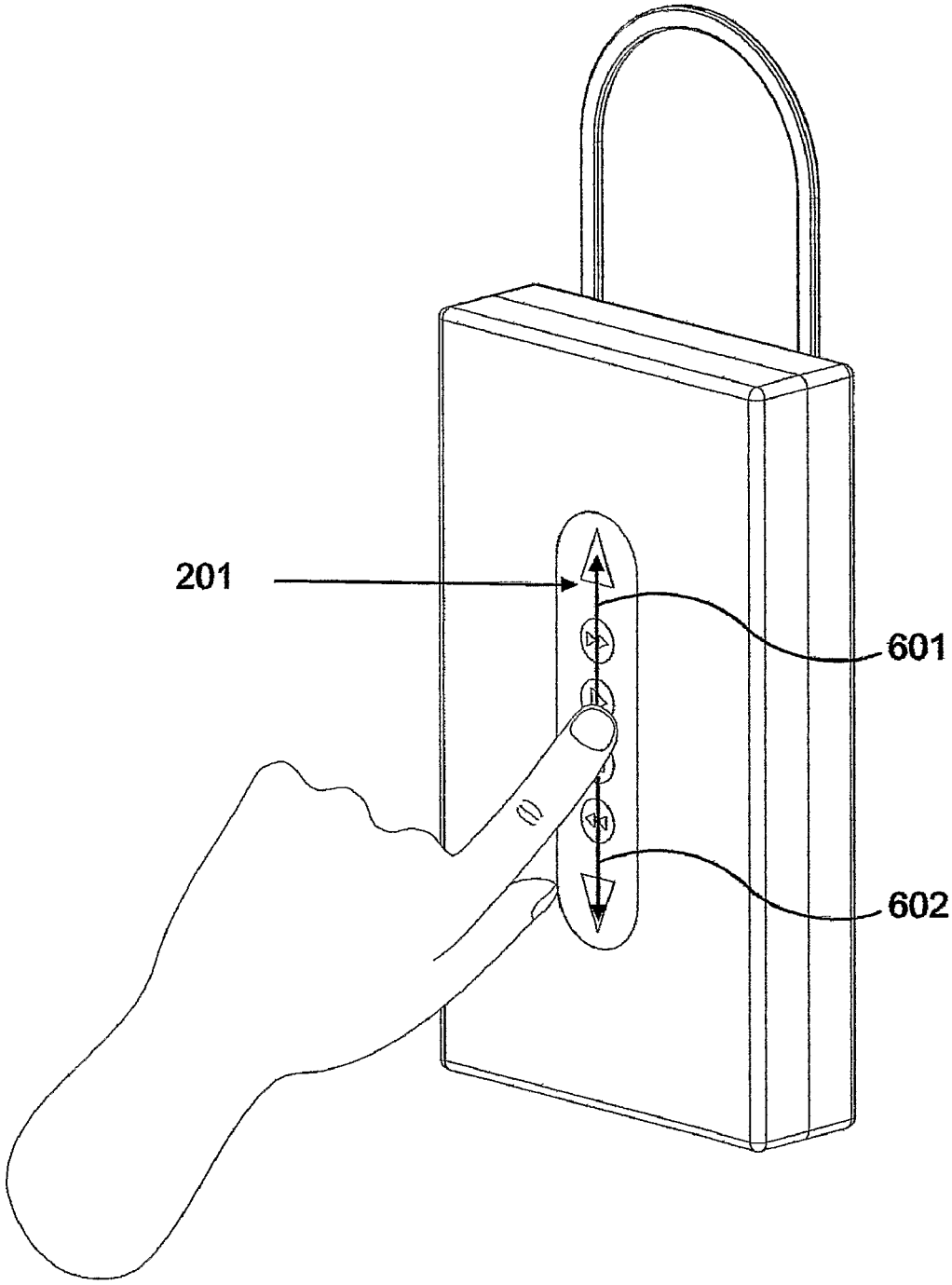

As illustrated in FIG. 6 the application of manual strokes or gestures to control portion 201 allows variable operations of the audio playback device to be controlled. In the illustrated example, manually applied strokes or gestures are processed to increase or decrease the output level of the audio playback device. Thus, a stroking operation in the direction of arrow 601 results in the output volume increasing until it reaches its maximum extent. Thus, in order to increase the output volume a finger is applied towards the bottom of portion 201 and stroked in an upwards direction. That is to say, movement of the finger in an upwards direction is caused while contact is maintained and held in pressure with portion 201.

Similarly, in order to reduce the output volume, a finger is applied to the portion 201 towards its upper extent and then moved downwardly in the direction of arrow 602 while remaining in contact, and then removed. Thus, in this way, without any external wires or plastic controls or moving parts etc it is possible to control the volume (or another variable operation) by direct manual application against a wall of the fabric bag itself.

FIG. 7

Figure 7:
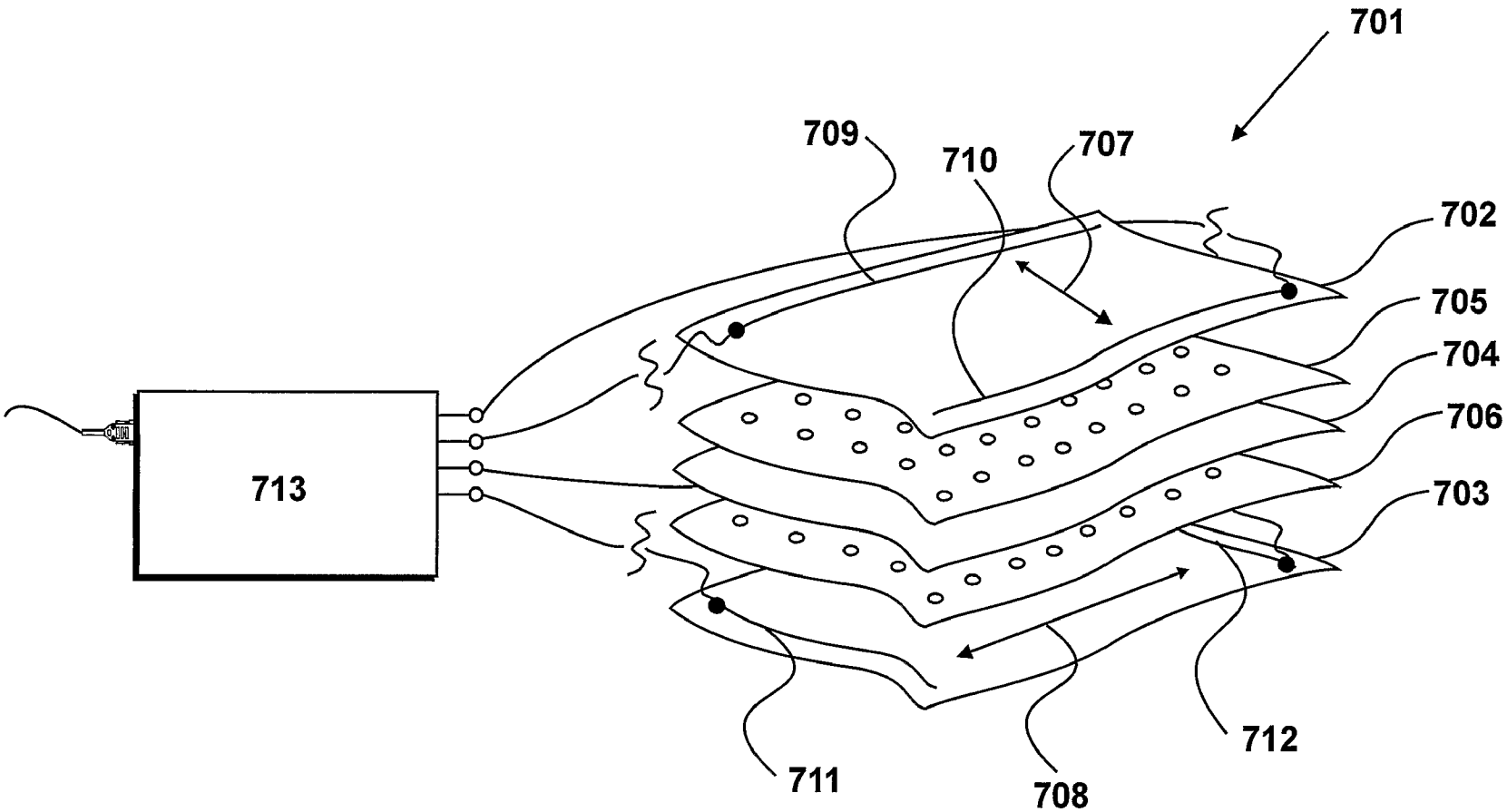
FIG. 7 shows a schematic of a construction of a control portion constructed substantially in fabric.

A schematic of a construction of a control portion 701 constructed substantially in fabric is shown in FIG. 7. The sensor 701 utilises a first conductive fabric layer 702, a second conductive fabric layer 703 and an intermediate layer 704 disposed between the first and second conductive fabric layers 702, 703. The intermediate layer 704 includes electrically conductive elements. The sensor 701 further comprises a first insulating separating layer 705 disposed between the first conductive fabric layer 702 and the intermediate conductive layer 704, and a second insulating separating layer 706 disposed between the second conductive fabric layer 703 and the intermediate conductive layer 704.

The first separating layer 705 is configured to separate the first conductive layer 702 and intermediate layer 704 in the absence of a mechanical interaction with the sensor 701. However, the first separating layer 705 is penetrable by the first conductive fabric layer during a mechanical interaction, to allow the first conductive layer 702 to make electrical contact with the conductive elements of intermediate layer 704. Similarly, the second separating layer 706 is configured to separate the second conductive layer 703 and intermediate conductive layer 704 in the absence of a mechanical interaction with the sensor 701. However, the second separating layer 706 is penetrable by the second conductive layer 703 during a mechanical interaction, to allow the second conductive layer 703 to make electrical contact with the conductive elements of intermediate layer 704. Through the conductive elements of the intermediate layer 704, a conductive path between the first and second conductive layers 702, 703 can be established at the position of a mechanical interaction with the sensor 701.

The first conductive fabric layer 702 includes conductive fibres arranged such that the first conductive layer is conductive in a first direction 707, along the layer. The second conductive fabric layer 703 also includes conductive fibres arranged such that the second conductive layer is conductive in a second direction 708, along the layer. In the arrangement shown the first and second directions 707, 708 are substantially perpendicular. The conductive fabric layers may have a weave, knit or felt construction.

The first conductive fabric layer 702 is provided with a first electrical conductor element 709 and a second electrical conductor element 710, positioned at opposed ends of a conductive path extending in the first direction 707. Similarly, the second conductive fabric layer 703 is provided with a third electrical conductor element 711 and a fourth electrical conductor element 712, positioned at opposed ends of a conductive path extending in the second direction 708.

A control circuit 713 is arranged to apply voltages to, and take measurements from, the fabric sensor 701.

When a voltage is applied across the first and second conductor elements 709, 710 a voltage gradient is established across the first conductive fabric layer 702. When a mechanical interaction takes place, a conductive path is established between the first conductive fabric layer 702 and the second conductive fabric layer 703, and the actual voltage applied to the second conductive fabric layer 703 will depend upon the position of the mechanical interaction along the first conductive path. This voltage can be measured to provide a first positional co-ordinate of the mechanical interaction.

Similarly, when a voltage is applied across the third and fourth conductor elements 711, 712 a voltage gradient appears across the second conductive fabric layer 703. When a mechanical interaction takes place, a conductive path is established between the second conductive fabric layer 703 and the first conductive fabric layer 702, and the actual voltage applied to the first conductive fabric layer 702 will depend upon the position of the mechanical interaction along the second conductive path. This voltage can be measured to provide a second positional co-ordinate of the mechanical interaction.

Thus, with reference to these two voltage measurements, it is possible to identify X-axis and/or Y-axis co-ordinates of a mechanical interaction within a sensing area.

WO 00/72239 A1 discloses a sensor and suitable control circuit operations for determining characteristics of mechanical interactions with the sensor; the entire disclosure of which is incorporated herein by reference in its entirety. WO 00/72239 A1 discloses a sensor for determining x and y co-ordinate data, along with z data relating to pressure. WO 00/072239 A1 discloses a sensor for detecting force and area of a mechanical interaction separately, along with x and y co-ordinates of the mechanical interaction.

FIG. 8

Figure 8:
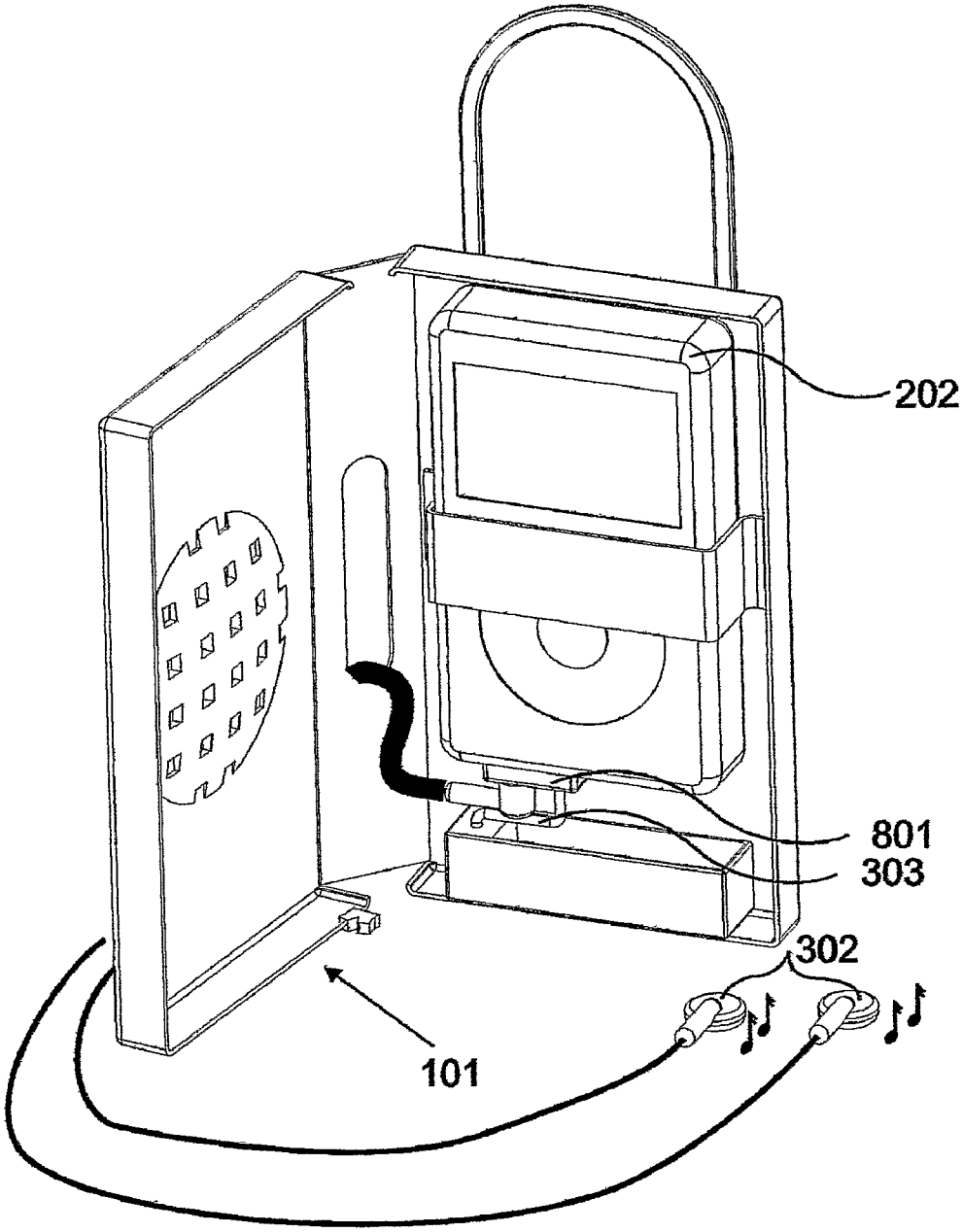
FIG. 8 shows an interface means.

The fabric bag 101 illustrated in FIGS. 1-4 is shown in an open configuration in FIG. 8, which shows an interface means 801 to facilitate the transmission of a modulated electrical (audio) signal to an audio transducer (earpiece).

The interface means 801 includes a connector having a socket for earphones 302, which when connected receive audio signals transmitted from the audio playback device 202.

Whilst the earphones 302 are in use, operations of the audio playback device 202, such as play/stop and volume, are controllable by manual operation of the control panel as previously described. As shown, the control lead 303 is also connected to interface means 801.

FIG. 9

Figure 9:
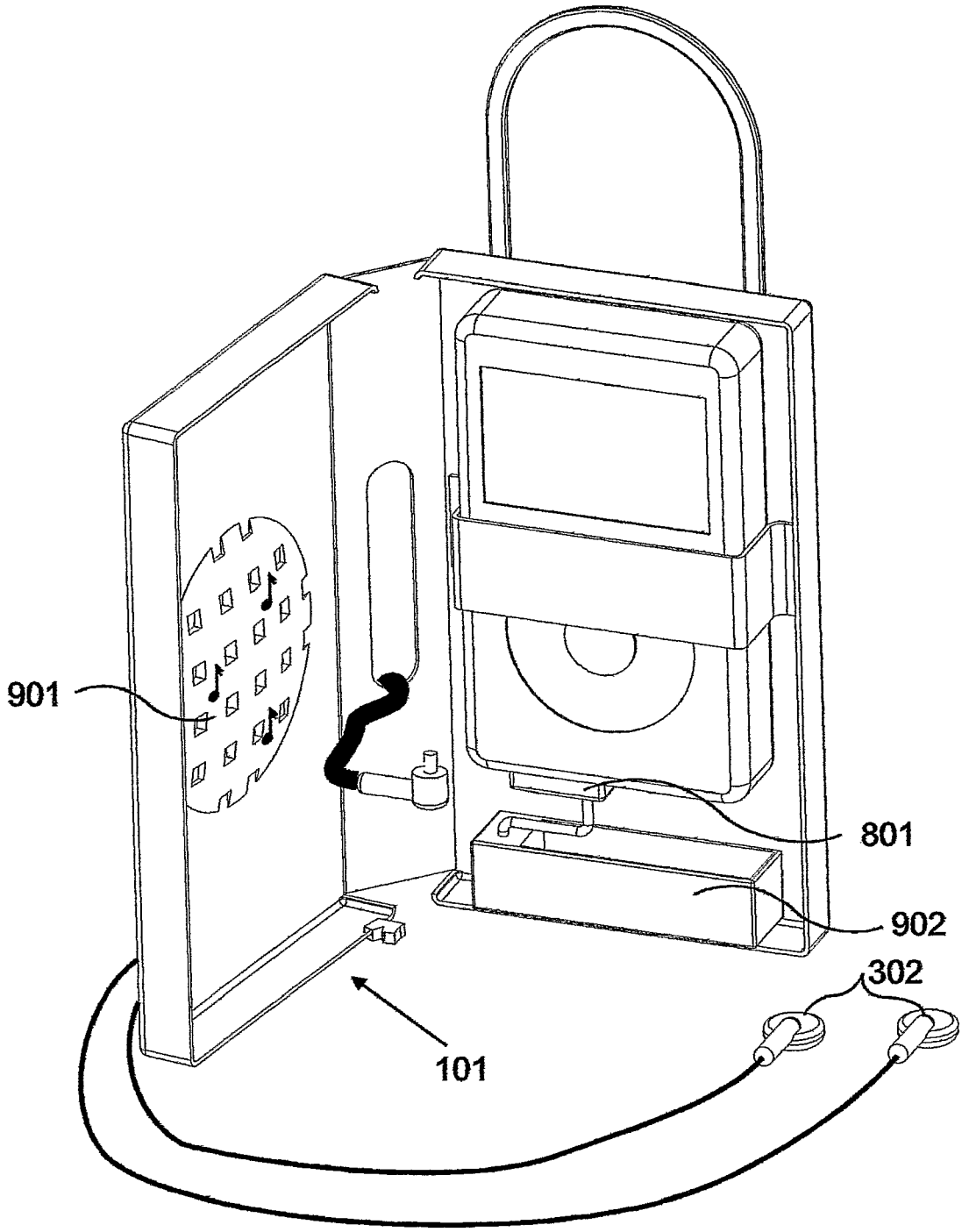
FIG. 9 shows an integral loudspeaker of a fabric bag.

As shown in FIG. 9, the fabric bag 101 may also include an amplifier and an integral loudspeaker 901, which may be concealed according to aesthetic requirements.

As illustrated in FIG. 9, when the earphones 302 are disconnected from interface means 801, audio signals transmitted from the audio playback device 202 are directed to the loudspeaker 901. Thus, audio signals from the audio device can be heard through the loudspeaker 901 when no earphones are connected. However, following connection of earphones, the audio signals are heard through the earpieces thereof. Whilst the loudspeaker 901 is in use, operations of the audio device, such as play/stop and volume, are also controllable by manual operation of the control panel as previously described.

The fabric bag may also be provided with storage means for receiving additional power supply devices. In this example, the bag 101 includes a storage pocket 902, which is accessed and closed by operation of a flap. Storage pocket 902 is configured to receive batteries, such as AA standard sized batteries, into an electrical arrangement such as provided for supplying power to the integral loudspeaker. It is to be appreciated that in applications in which such storage means is provided, the type and dimensions of the storage means may vary between different applications.

FIG. 10

Figure 10:
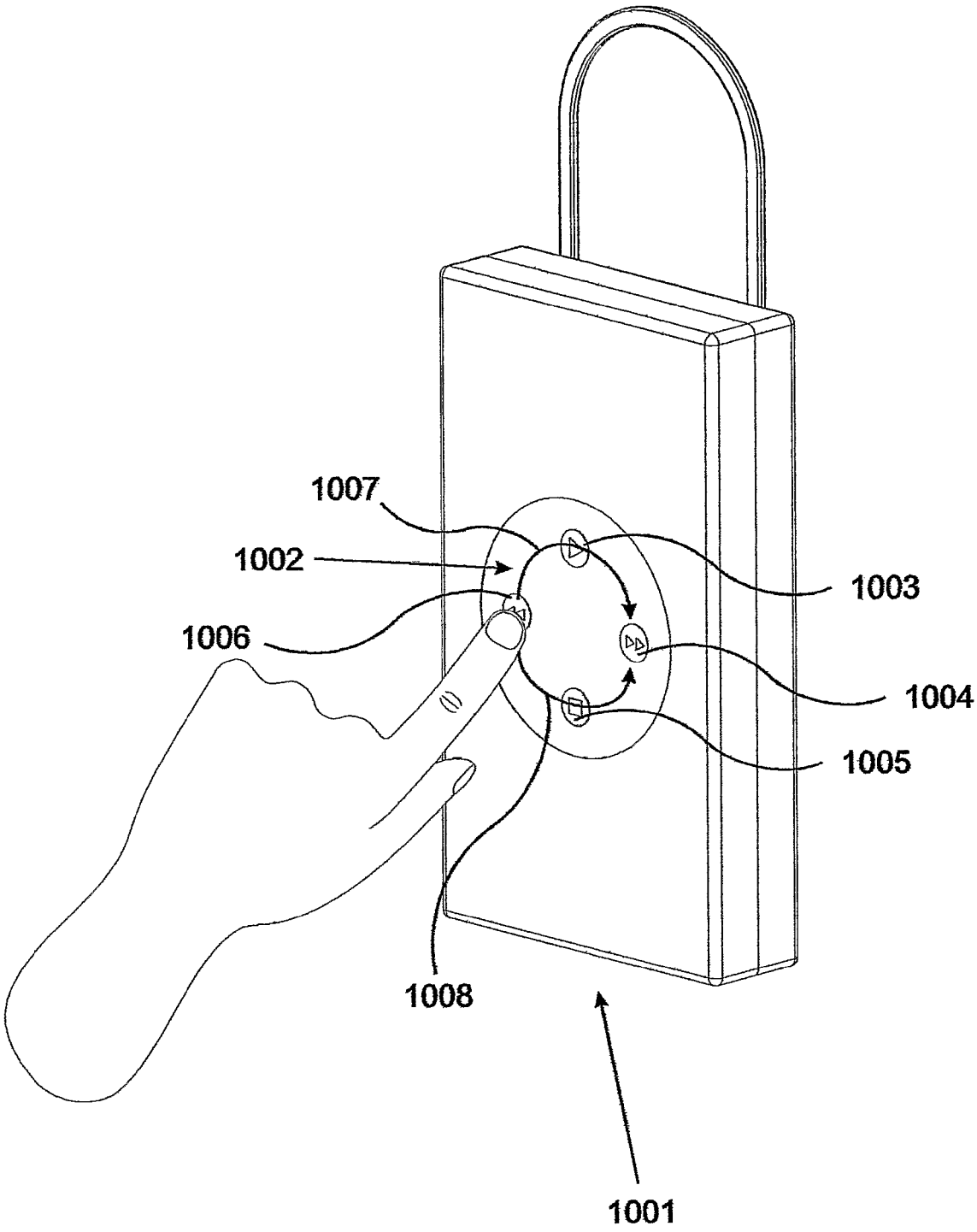
FIG. 10 shows a second control portion constructed substantially in fabric of a second fabric bag.

FIG. 10 shows a fabric bag 1001 for holding an audio playback device that includes a circular control portion 1002. The circular control portion 1002 provides enables control of both discrete and variable operations of an audio playback device.

In this example, the indicated regions include a first region 1003, a second region 1004, a third region 1005 and a fourth region 1006. In FIG. 10, a manual press is shown against region 1006, which results in a rewind operation. A manual press applied to individual regions 1003, 1004 and 1005 results in the activation of a play, a fast forward and a stop operation respectively.

However, the control portion 1002, even at the positions of the specific regions, remains sensitive to manually applied strokes or gestures. In addition to the indicated regions being responsive to individually applied manual presses so as to control discrete operations of an audio playback device, the circular portion 1002, including the indicated regions, is responsive to manually applied strokes or gestures so as to control variable operations of the audio playback device.

Manually applied strokes or gestures may be processed to increase or decrease the output level of the audio playback device. A stroking operation in the direction of arrow 1007 results in the output volume increasing until it reaches its maximum extent. Thus, in order to increase the output volume a finger is applied to the circular portion 1002 and stroked in a clockwise direction. That is to say, movement of the finger in a clockwise direction is caused while contact is maintained and held in pressure with portion 1002.

Similarly, in order to reduce the output volume, a finger is applied to the circular portion 1002, motioned in the opposite anticlockwise direction, in the direction of arrow 1008, while remaining in contact, and then removed. Thus, in this way, without any external wires or plastic controls or moving parts etc it is possible to control the volume (or another variable operation) by direct manual application against the surface of the control portion 1002.

Thus, in this way, substantially the same portion of the control device can be used to send instructions to control discrete operations (switching a device on and off etc) and to control variable operations (such as volume and tone control etc). Thus, the indicated control regions can be viewed as being superimposed on the substantially circular portion of the control device. The substantially circular portion may be contained within a non-circular perimeter.

What is claimed is:

1. A fabric bag for holding an audio playback device, wherein said fabric bag includes a control device constructed substantially in fabric for controlling said audio playback device, the control device comprising:

a control portion having indicated regions thereon;

a first fabric electrically conducting layer, a second fabric electrically conducting layer, an intermediate fabric layer disposed between said first fabric electrically conducting layer and said second fabric electrically conducting layer, said intermediate fabric layer including conductive elements, a first insulating separating means disposed between said first fabric electrically conducting layer and said intermediate fabric layer, and a second insulating separating means disposed between said second fabric electrically conducting layer and said intermediate fabric layer; wherein said indicated regions are responsive to individually applied manual presses so as to control discrete operations of said audio playback device, and said control portion, including said indicated regions, is responsive to manually applied strokes or gestures so as to control variable operations of said audio playback device; and said conductive elements of said intermediate fabric layer provide a conductive path between said first fabric electrically conducting layer and said second fabric electrically conducting layer at the position of a mechanical interaction.

2. A fabric bag as claimed in claim 1, wherein said control portion has a substantially circular shape.

3. A fabric bag as claimed in claim 2, wherein said control portion, including said indicated regions, is responsive to manually applied strokes or gestures applied in a clockwise direction and in an anticlockwise direction.

4. A fabric bag as claimed in claim 1, wherein said control portion is substantially linear.

5. A fabric bag as claimed in claim 1, wherein said discrete operations includes one of: play, stop, move forward, move in reverse, select and mute.

6. A fabric bag as claimed in claim 1, wherein said variable operations includes one of: volume level control, tone control and menu scrolling.

7. A fabric bag as claimed in claim 1, including supporting means for supporting an audio playback device within said fabric bag.

8. A fabric bag as claimed in claim 1, including carrying means to facilitate the carrying of said fabric bag.

9. A fabric bag as claimed in claim 1, wherein said audio playback device produces an audio output signal from digital data files.

10. A fabric bag as claimed in claim 1, including an interface means to facilitate the transmission of a modulated electrical (audio) signal to an audio transducer (earpiece).

11. A fabric bag as claimed in claim 1, including storage means for receiving additional power supply devices.

12. A fabric bag as claimed in claim 1, including an amplifier and an integral loudspeaker.

13. A fabric bag as claimed in claim 1, wherein said first fabric electrically conducting layer has a first electrical conductor element and a second electrical conductor element, said second fabric electrically conducting layer has a third electrical conductor element and a fourth electrical conductor element, and said control device further comprises a control circuit arranged to establish a voltage gradient across a first of said first fabric electrically conducting layer and said second fabric electrically conducting layer and to measure an applied voltage from the second of said first fabric electrically conducting layer and said second fabric electrically conducting layer.

* * * * *